US007628189B1

(12) United States Patent
Beckley

(10) Patent No.: US 7,628,189 B1
(45) **Date of Patent: *Dec. 8, 2009**

(54) INSERT POCKETS FOR A WALLET

(76) Inventor: Alan Beckley, 937 Lombardy Dr., Plano, TX (US) 75023

( * ) Notice: Subject to any disclaimer, the term of this patent is extended or adjusted under 35 U.S.C. 154(b) by 0 days.

This patent is subject to a terminal disclaimer.

(21) Appl. No.: 11/676,089

(22) Filed: Feb. 16, 2007

Related U.S. Application Data

(63) Continuation-in-part of application No. 11/174,678, filed on Jul. 5, 2005, now abandoned, which is a continuation-in-part of application No. 10/305,203, filed on Nov. 26, 2002, now Pat. No. 6,923,229.

(51) Int. Cl.
*A45C 1/06* (2006.01)

(52) U.S. Cl. ..... 150/138; 150/145; 150/148

(58) Field of Classification Search ..... 150/145, 150/147–149, 138, 144; 206/39, 425, 37; 40/771; 383/35

See application file for complete search history.

(56) References Cited

U.S. PATENT DOCUMENTS

| | | | | | |
|---|---|---|---|---|---|
| 1,446,638 | A * | 2/1923 | Brown | 281/38 |
| 2,451,122 | A * | 10/1948 | Sherwood | 150/138 |
| 2,726,758 | A * | 12/1955 | Brower | 206/39 |
| 2,982,322 | A * | 5/1961 | Seitz | 150/147 |
| 3,146,816 | A * | 9/1964 | Osher | 150/148 |
| 3,241,588 | A * | 3/1966 | Benjamin et al. | 150/147 |
| 3,424,636 | A * | 1/1969 | Brody | 156/201 |
| 3,759,305 | A * | 9/1973 | McIntyre | 150/149 |
| 3,994,328 | A * | 11/1976 | Reis | 150/143 |
| 4,363,345 | A * | 12/1982 | Scheibner | 383/63 |
| 4,851,610 | A * | 7/1989 | LeBlanc et al. | 174/353 |
| 4,899,879 | A * | 2/1990 | Rosen | 206/445 |
| 4,978,055 | A * | 12/1990 | Miller | 229/72 |
| 5,431,207 | A * | 7/1995 | Siegel | 150/139 |
| 5,449,066 | A * | 9/1995 | Caine | 206/232 |
| 5,575,880 | A * | 11/1996 | Strassberg | 156/251 |
| 5,601,681 | A * | 2/1997 | Bayro | 156/268 |
| 5,727,683 | A * | 3/1998 | Zeid | 206/387.11 |
| 5,832,145 | A * | 11/1998 | Dais et al. | 383/211 |
| 6,361,210 | B2 * | 3/2002 | Denko | 383/35 |
| 6,519,796 | B2 * | 2/2003 | Sloot | 5/636 |
| 2004/0066031 | A1 * | 4/2004 | Wong et al. | 281/31 |
| 2004/0108032 | A1 * | 6/2004 | Lyons | 150/132 |
| 2005/0252591 | A1 * | 11/2005 | Beckley | 150/138 |

* cited by examiner

*Primary Examiner*—Sue A Weaver
(74) *Attorney, Agent, or Firm*—Michael Diaz

(57) ABSTRACT

An insert pocket for a wallet. The insert pocket includes a front panel and a back panel adhering to the front panel about a border of the insert pocket. The front panel and back panel form an interior area sized and shaped to retain a card. A plurality of burbles are located within the interior area adjacent the border. The burbles reinforce the insert pocket and retain the card within the interior area of the insert pocket. The insert pocket may be utilized in any type of wallet for retaining cards.

12 Claims, 7 Drawing Sheets

INSERT POCKETS FOR A WALLET

RELATED APPLICATIONS

This application is a continuation-in-part of a U.S. patent application Ser. No. 11/174,678 by Alan Beckley entitled "WALLET FOR RETAINING A PLURALITY OF CREDIT CARDS," filed Jul. 5, 2005, now abandoned which is a continuation-in-part of Ser. No. 10/305,203 U.S. Pat. No. 6,923,229 by Alan Beckley entitled "WALLET FOR RETAINING A PLURALITY OF CREDIT CARDS," filed Nov. 26, 2002 and is hereby incorporated in its entirety by reference herein.

BACKGROUND OF THE INVENTION

1. Field of the Invention

This invention relates to wallets, and more particularly, to a insert pocket for use within a wallet.

2. Description of Related Art

As discussed in U.S. Pat. No. 6,923,229 to Beckley (Beckley), existing conventional wallets have been used for quite a long time for carrying currency. However, these existing wallets are not configured to provide a slim profile when carrying a plurality of credit cards. Because of the thickness and unwieldiness of the conventional wallets, the user must be resigned to a large bulge in the back pocket or simply carrying the wallet to avoid carrying such a thick object in pockets. The wallet disclosed in Beckley provided a novel configuration for carrying the cards in a thin profile. U.S. patent application Ser. No. 11/174,678 ('678) provides inserts which securely retain cards and provide ease in retrieval of the cards.

Both Beckley and '678 provide a wallet which allows the carriage of a large number of credit cards in a compact configuration while allowing quick and simple access to the cards retained in the wallet. However, because the insert pockets carry the cards in a tighter fit than conventional wallets, considerable stress is placed on the pockets, especially on the edges where the back panel and front panel are adhered. In addition, because the insert pockets are relatively narrow, the user tends to press the cards against the upper outside corners of the pockets when sliding the cards back into the pockets. Thus, there is a tendency to weaken the upper attachments points of the pockets. In addition, there is a tendency for cards positioned within the pockets to slide out of the top of the insert pockets if the user positions the wallet upside down, thereby causing the cards to move freely and easily into and out of the pockets.

FIG. 1 is an enlarged front view of an existing insert pocket 10. The insert pocket includes a front panel 12, a back panel 14 and an opening 16. The front panel is adhered to the back panel along a border 18. FIG. 2 is a front view of the insert pocket illustrating wear upon a left hand upper corner of the insert pocket whereupon a tear has begun near corner 22. FIG. 3 is a front view of the insert pocket of FIG. 2 with a card 20 inserted within the pocket. The insert pocket tends to tear about upper corners 22 and 24. The tear, over time, tears downwardly. FIG. 4 illustrates the insert pocket being torn along a side tear 30. Eventually, the entire side 30 may tear allowing the card 20 to slide out. Thus, it would be a distinct advantage to have an insert pocket which secures cards within the pocket without causing tearing of the insert pocket during extended use. It is an object of the present invention to provide such a device.

SUMMARY OF THE INVENTION

In one aspect, the present invention is an insert pocket for a wallet. The insert pocket includes a front panel and a back panel adhering to the front panel about a border of the insert pocket. The front panel and back panel form an interior area sized and shaped to retain a card. A plurality of burbles (small accumulations) of plastic or similar material having roughly circular shapes) are located within the interior area adjacent the border. The burbles reinforce the insert pocket and retain the card within the interior area of the insert pocket.

In another aspect, the present invention is a wallet for retaining a plurality of cards. The wallet includes a bi-fold wallet case having a lateral opening running a substantial length of the wallet case. The lateral opening leads to an interior of the wallet case. An insert is attached to the wallet case. The insert includes several pages. Each page has at least two insert pockets. Each insert pocket has a front panel and a back panel adhering to the front panel about a border of the insert pocket. The front panel and back panel form an interior area sized and shaped to retain a card. A plurality of burbles are located within the interior area adjacent the border. The burbles reinforce the insert pocket and retain the card within the interior area of the insert pocket. The cards on each page are aligned in a non-overlapping and adjacent configuration and the plurality of pages are arranged in photo album fashion. The insert retains a plurality of cards and the wallet case is capable of retaining currency bills.

DESCRIPTION OF THE INVENTION

Figure 1:
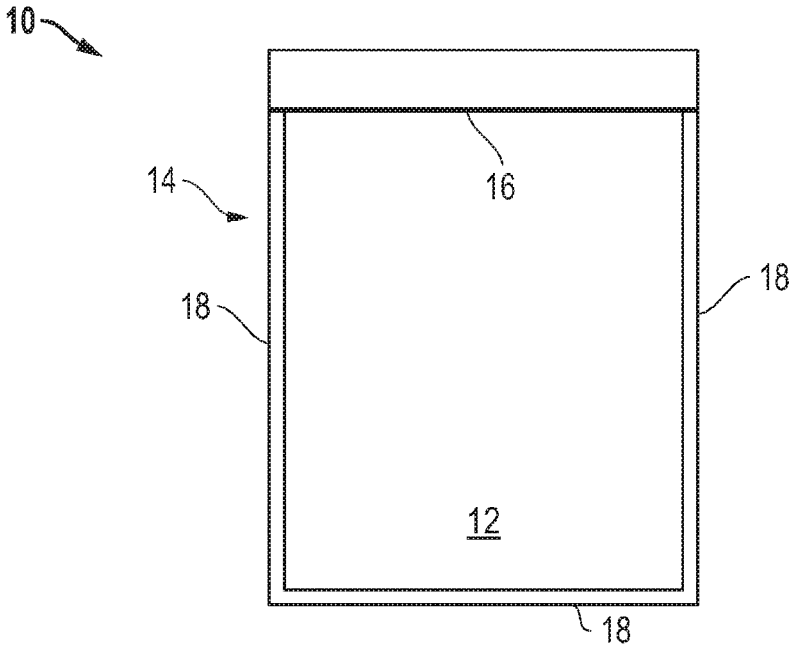
FIG. 1 (Prior Art)
FIG. 1 (prior art) is a front view of an existing insert pocket.
Figure 2:
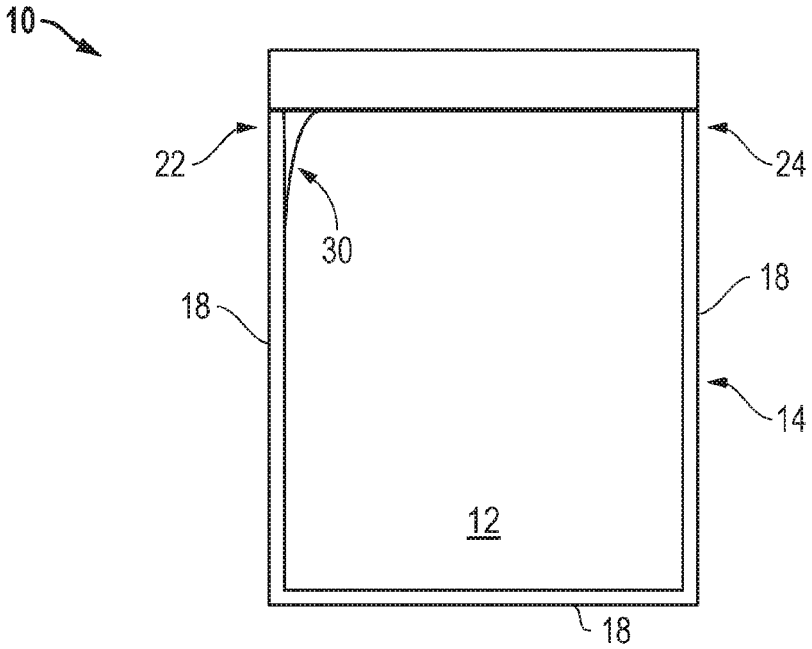
FIG. 2 (Prior Art)
FIG. 2 (prior art) is a front view of the insert pocket of FIG. 1 illustrating wear upon a corner of the insert pocket.
Figure 3:
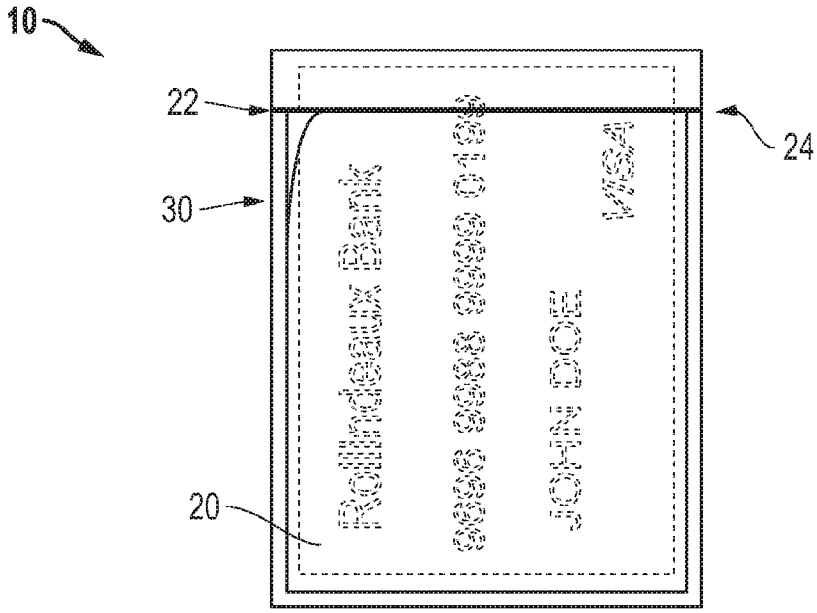
FIG. 3 (Prior Art)
FIG. 3 (prior art) is a front view of the insert pocket of FIG. 2 with a card inserted within the pocket.
Figure 4:
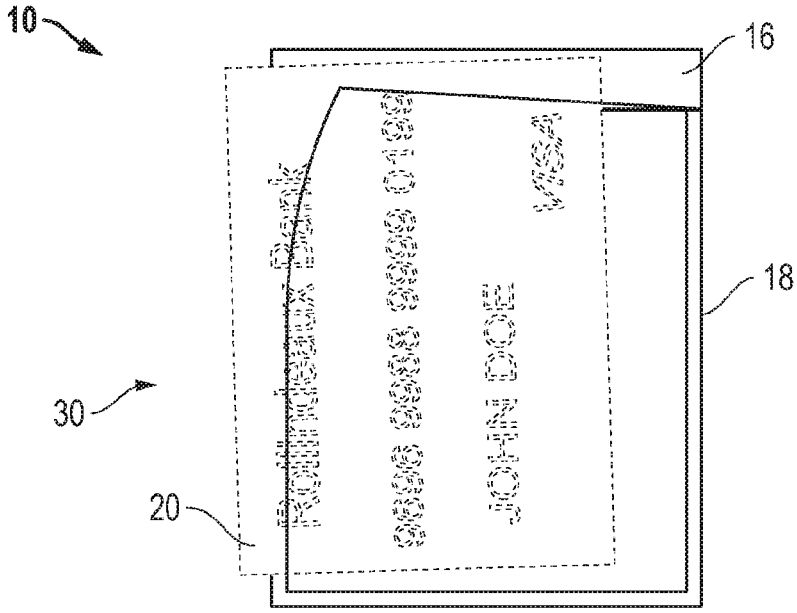
FIG. 4 (Prior Art)
FIG. 4 (prior art) illustrates the insert pocket being torn along a side.
Figure 5A:
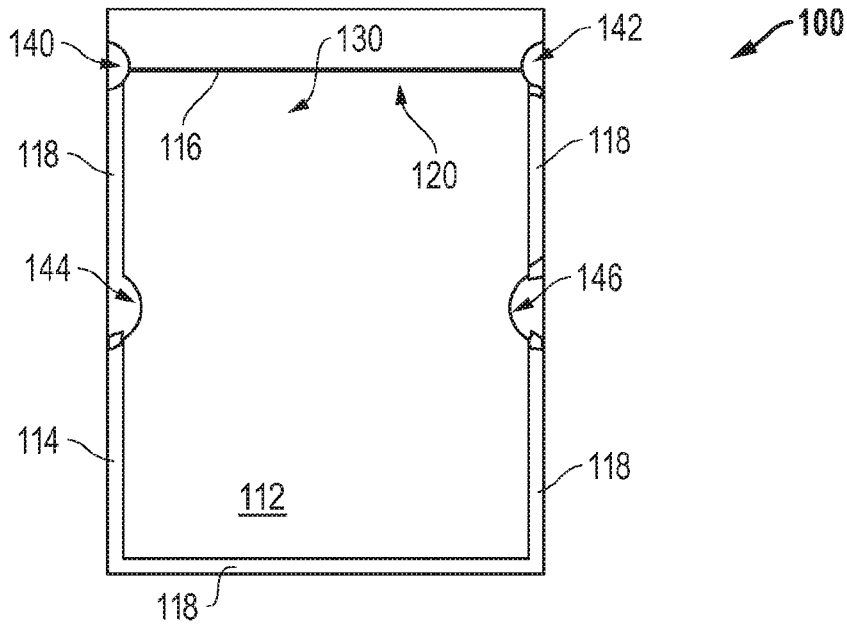
FIG. 5*a* is a front view of a single vertically oriented insert pocket in the preferred embodiment of the present invention.
Figure 5B:
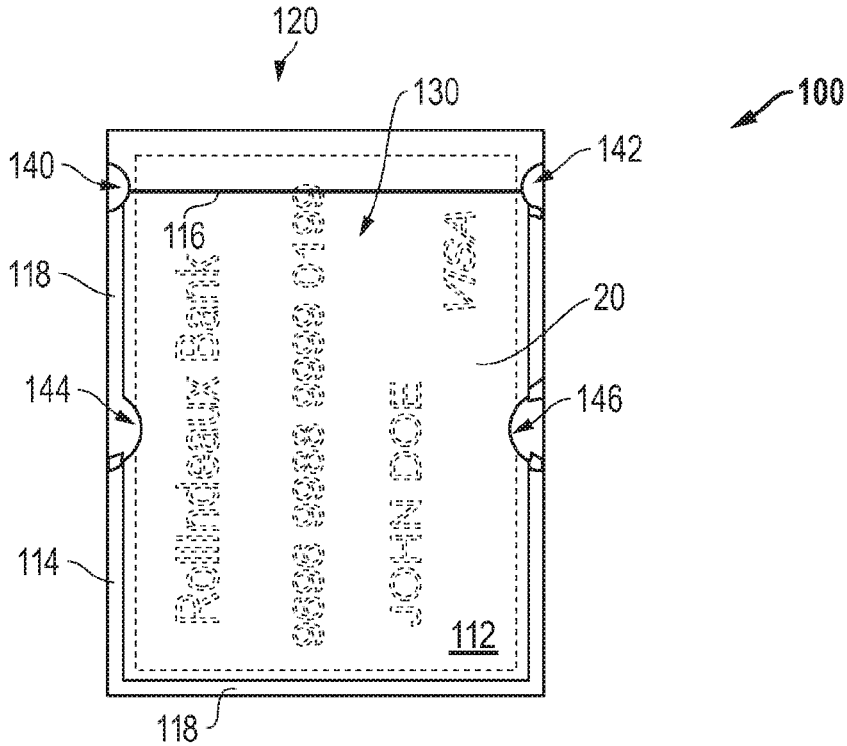
FIG. 5*b* is a front view of the insert pocket of FIG. 5*a* with a card inserted within the insert pocket.

An insert pocket for a wallet. FIG. 5*a* is a front view of a single vertically oriented insert pocket 100 in the preferred embodiment of the present invention. FIG. 5*b* is a front view of the insert pocket of FIG. 5*a* with a card inserted within the insert pocket. In a similar construction as the existing insert pocket 10, the insert pocket 100 includes a front panel 112 affixed to a back panel 114 with an adhering material at a border 118. At a top portion 120 of the insert pocket 100 is an opening 116 allowing entry and exit of a card 20 into an interior portion 130 of the insert pocket 100. In the preferred embodiment of the present invention, a plurality of burbles (beads) 140, 142, 144, and 146 are utilized for reinforcement of the insert pocket and retention of the cards within the interior portion of the insert pocket. The burbles are approximately circular beads of plastic providing an additional thickness from the border or front and back panels. Preferably, the burbles 140 and 142 are located near the top portion 130 abeam the openings. Burbles 144 and 146, which are preferably slightly larger than the burbles 140 and 142, are located on the border at an approximately center position of the insert pocket 100.

The insert and burbles are constructed of a durable material (preferably water resistant), such as plastic. The burbles are preferably constructed of a material having greater depth than the remaining portions of the pocket insert.

Figure 6:
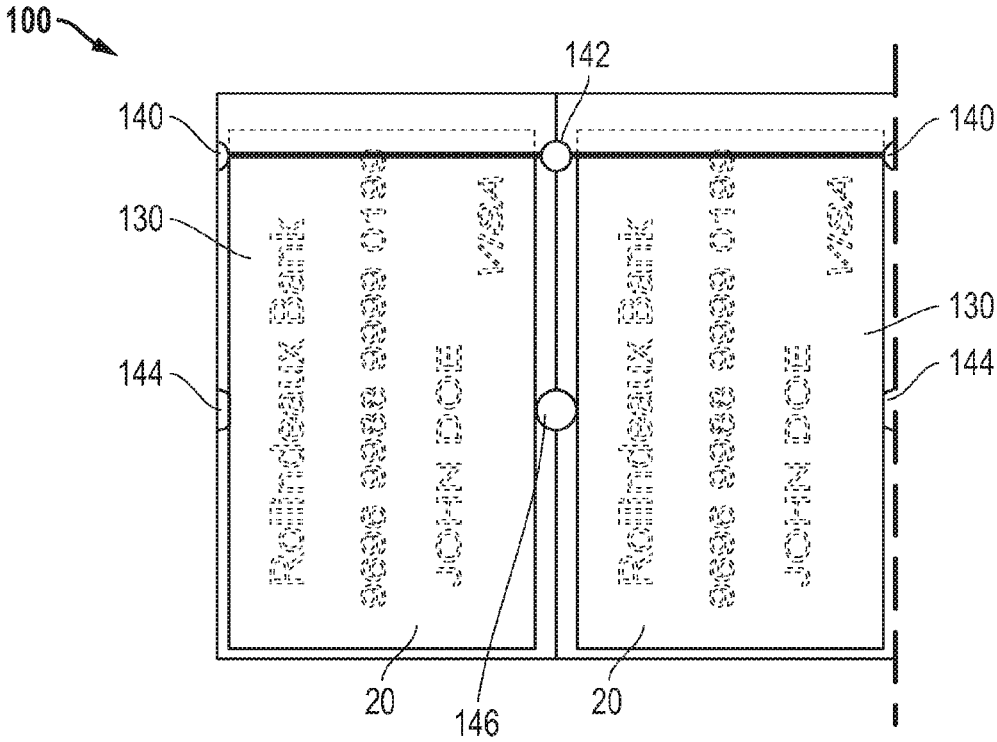
FIG. 6 is a front view of two vertically oriented insert pockets with cards inserted within the interior portion of the insert pockets

FIG. 6 is a front view of two vertically oriented insert pockets 100 with cards inserted within the interior portion 130 of the insert pockets. The burbles 140 and 142 are primarily utilized as reinforcing material for the insert pockets 100 to prevent the insert pockets from tearing at the sides.

Figure 7A:
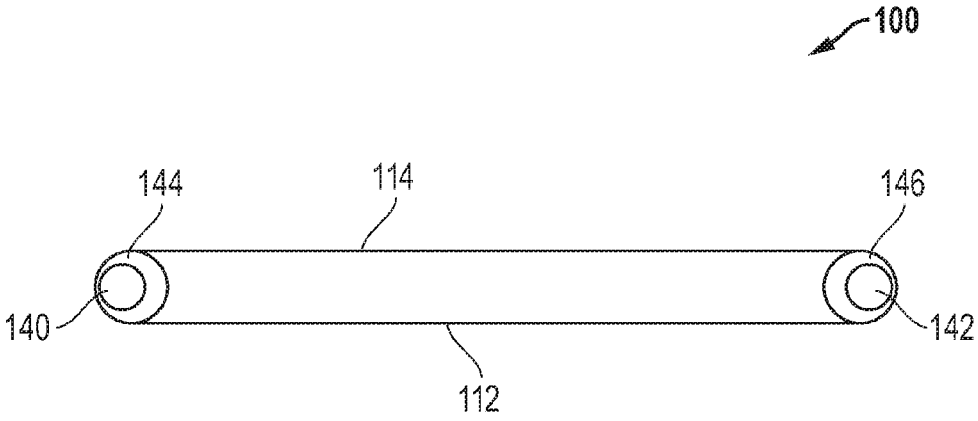
FIG. 7*a* is a top view of the insert pocket illustrating the insert pocket with burbles within the insert pocket.
Figure 7B:
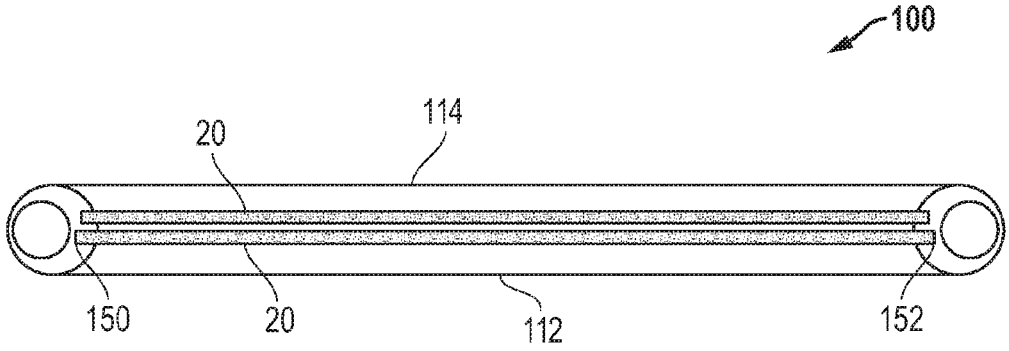
FIG. 7*b* is a top view of the insert pocket illustrating the insert pocket with burbles with two inserted into the pocket for the first time.
Figure 7C:
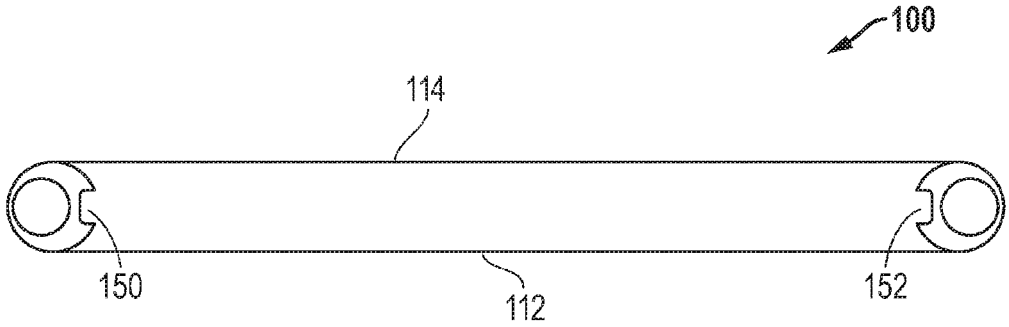
FIG. 7*c* is a top view of the insert pocket illustrating the insert pocket with burbles after the removal of the two cards.

FIG. 7*a* illustrates a top view of the insert pocket 100 with preferably smaller burbles 140 and 142 near the top of the pocket and preferably larger burbles 144 and 146 near the middle of the pocket. However, in alternate embodiments of the present invention, the burbles may be of an size (e.g., larger burbles located near the top). FIG. 7*b* shows a top view of the insert pocket when two cards have been inserted into the pocket for the first time. The middle burbles 144 and 146 are, in the preferred embodiment, of sufficient depth so that the cards carve channels 150 and 152 into the middle burbles. FIG. 7*c* shows a top view of the pocket with cards removed. The channels 150 and 152 have been carved within a mid-section of the middle burbles 144 and 146 by the cards.

By utilizing the plurality of burbles 140, 142, 144, and 146, cards positioned within the interior portion 130 of the insert pocket 100 are held in position even if the wallet to which the insert pockets are utilized is turned upside down.

Figure 8:
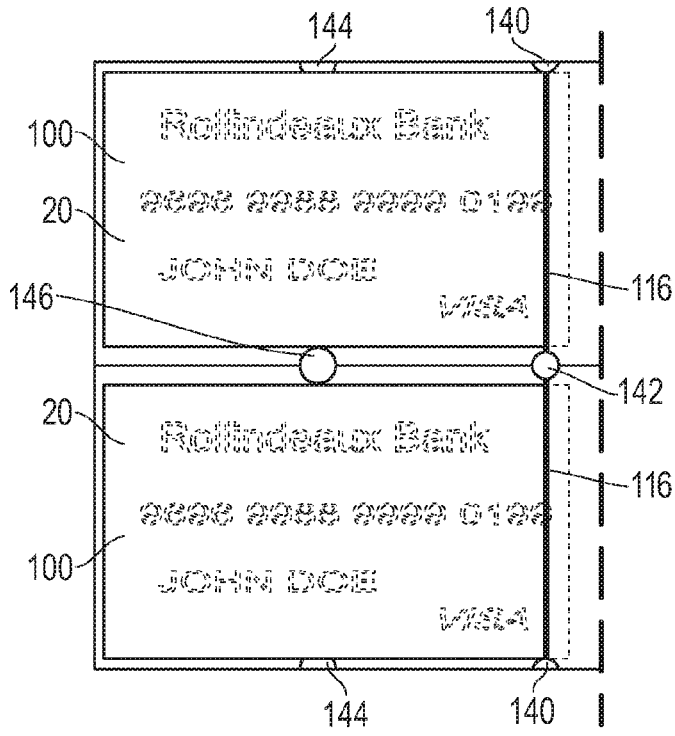
FIG. 8 is a front view of the insert pocket having horizontally oriented pockets in a first alternate embodiment of the present invention.
Figure 9:
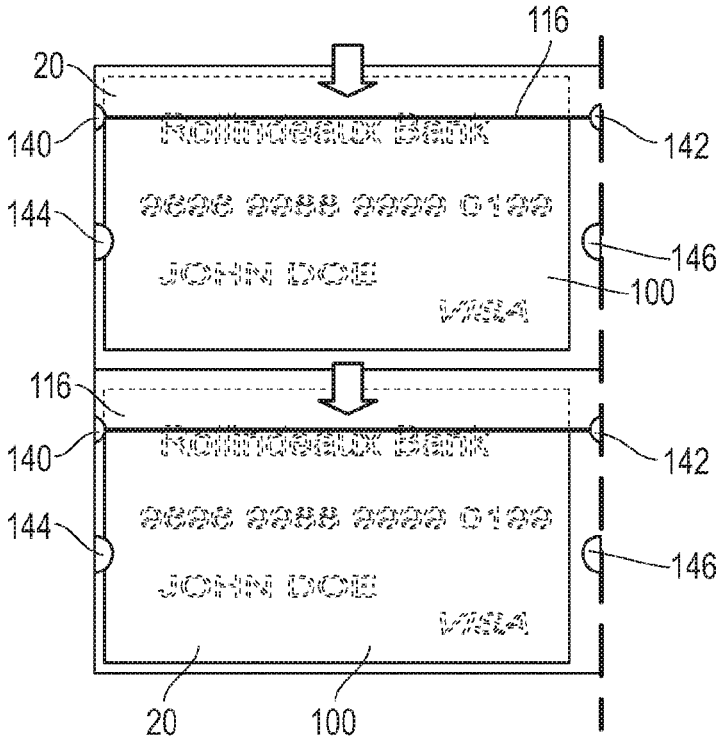
FIG. 9 is a front view of the insert pocket having horizontally oriented pockets in a second alternate embodiment of the present invention.

FIG. 8 is a front view of the insert pocket 100 having horizontally oriented pockets in a first alternate embodiment of the present invention. As illustrated in FIG. 8, the cards 20 are inserted into the pockets from the side or horizontally. FIG. 9 is a front view of the insert pocket 100 having horizontally oriented pockets. As illustrated in FIG. 9, the cards 20 are inserted into the pockets from the top (vertically). It should be understood that the pocket insert may be oriented in any direction with one or more other adjacently positioned insert pockets.

The burbles provide several distinct advantages for insert pockets. The top burbles 140 and 142 serve as guides for inserting a card within the interior portion by centering and orientating the card edges parallel to the insert pocket. The centrally located burbles 144 and 146 provide additional resistance to prevent the cards from inadvertently being removed. The burbles also act as a buffer between the border of the insert pocket and the edge of the card, thereby preventing the card edges from cutting into the border. Additionally, the top burbles provide reinforcement to prevent the side tears prevalent with existing insert pockets. The present invention is preferably utilized in the wallet disclosed in Beckley. However, in alternate embodiments of the present invention, the pocket inserts may be utilized in any wallet having any type of pocket insert.

Figure 10:
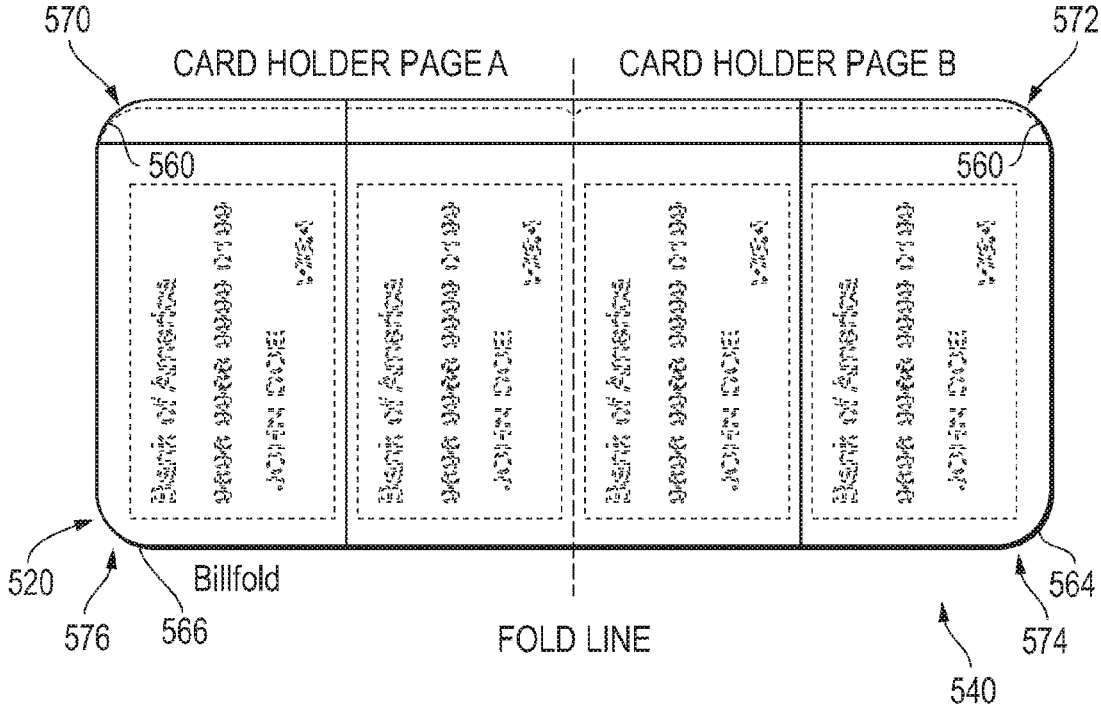
FIG. 10 is a front view of an insert within a wallet in an alternate embodiment of the present invention.

FIG. 10 is a front view of an insert 540 within a wallet 520 in an alternate embodiment of the present invention. The insert may include rounded corners 560, 562, 564, and 566. Additionally, the wallet may include rounded corners 570, 572, 574, and 576. The rounded corners may be used to provide ease in retrieval and insertion of the wallet from a user's back pocket. The rounded corners for the insert and/or wallet may be utilized in any embodiment of the present invention.

Figure 11:
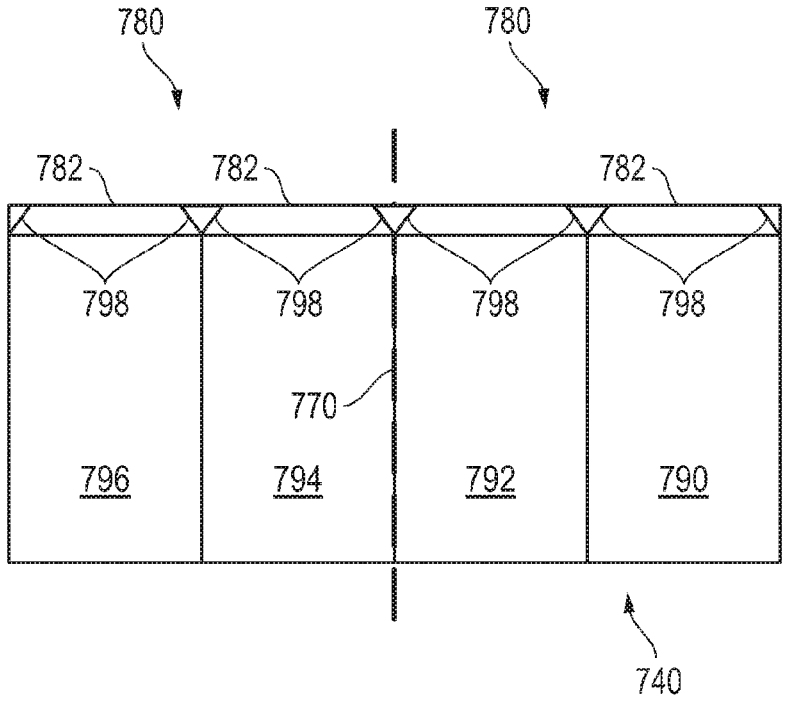
FIG. 11 is a front view of an insert removed from the wallet in an alternate embodiment of the present invention.

FIG. 11 is a front view of an insert 740 removed from the wallet 720 in an alternate embodiment of the present invention. The insert 740 includes a plurality of pockets 790, 792, 794, and 796 (preferably four side by side). At an upper portion 780 of each pocket is located the radiused edges 782. The pockets are used to hold cards (e.g., credit cards, identification, etc.) within its interior. As illustrated, the insert is a single piece of material attached at the spine 770. In this alternate embodiment, the radiused edges include hooded corners 798. As depicted in FIG. 11, the hooded corners are pieces of material having a pocket for retaining a corner of a retained card. The corner edge of the retained card is tucked within this pocket area of the hooded corners, thereby preventing the card from falling out of the pocket. The hooded corners prevent retained cards from sliding out of the pockets.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. An insert pocket for a wallet, the insert pocket comprising:

a front panel;

a back panel adhering to the front panel about a border of the insert pocket;

the front panel and back panel forming an interior area sized and shaped to retain a card;

a plurality of beads located within the interior area adjacent the border;

wherein the plurality of beads include at least two beads located at an approximately middle portion of the insert pocket;

the insert pocket being configured to hold a card in a substantially vertical orientation;

a longest length of the card being aligned parallel to a spine of a wallet;

wherein the insert pocket includes an opening for inserting the card within the interior area;

whereby the beads reinforce the insert pocket and retain the card within the interior area of the insert pocket.

2. The insert pocket for a wallet of claim 1 wherein the plurality of beads include at least two beads located adjacent the opening.

3. The insert pocket for a wallet of claim 1 wherein the two beads located approximately at a middle portion of the insert pocket includes channels to guide the card within the interior area of the insert pocket.

4. The insert pocket for a wallet of claim 1 wherein each bead is constructed of a material thicker than the front and back panels.

5. The insert pocket for a wallet of claim 1 wherein the insert pocket includes rounded corners.

6. The insert pocket for a wallet of claim 5 wherein the opening includes at least one hooded corner, whereby a card is positioned within the interior area of the pocket and retained by the hooded corner.

7. An insert pocket for a wallet, the insert pocket comprising:

a front panel;

a back panel adhering to the front panel about a border of the insert pocket;

the front panel and back panel forming an interior area sized and shaped to retain a card;

a plurality of beads located within the interior area adjacent the border;

the insert pocket being configured to hold a card;

wherein the insert pocket includes an opening for inserting the card within the interior area;

wherein the plurality of beads include at least two beads for retaining the card within the interior area, the two beads being located at an approximately middle portion of the insert pocket;

whereby the beads reinforce the insert pocket and retain the card within the interior area of the insert pocket.

8. A wallet for retaining a plurality of cards, the wallet comprising:

a bi-fold wallet case having a lateral opening running a substantial length of the wallet case, the lateral opening leading to an interior of the wallet case; and an insert attached to the wallet case, the insert having a plurality of pages, each page having at least two insert pockets, each insert pocket having:

a front panel;

a back panel adhering to the front panel about a border of the insert pocket;

the front panel and back panel forming an interior area sized and shaped to retain a card;

a plurality of beads located within the interior area adjacent the border;

wherein the plurality of beads include at least two beads located at an approximately middle portion of each insert pocket;

the beads reinforcing the insert pocket and retaining the card within the interior area of the insert pocket;

wherein the cards on each page are aligned in a non-overlapping and adjacent configuration, the plurality of pages being arranged in photo album fashion;

the pockets being configured to hold cards in a substantially vertical orientation;

a longest length of each card being aligned parallel to a spine of the wallet case when retained in the pocket;

wherein each pocket includes an opening for inserting a card within the interior area of the pocket;

whereby the insert retains a plurality of cards and the wallet case capable of retaining currency bills, the wallet case being sized to fit within a back pocket of a carrier of the wallet.

9. The wallet of claim 8 wherein the plurality of beads include at least two beads located adjacent the opening for each insert pocket.

10. The wallet of claim 8 wherein the insert pocket includes rounded corners.

11. The wallet of claim 8 wherein the opening includes at least one hooded corner, whereby a card is positioned within the interior area of the pocket and retained by the hooded corner.

12. The insert pocket of claim 11 wherein the two beads located approximately at a middle portion of the insert pocket includes channels to guide the card within the interior area of the insert pocket.

* * * * *